US006576600B1

(12) United States Patent
Imai et al.

(10) Patent No.: US 6,576,600 B1
(45) Date of Patent: Jun. 10, 2003

(54) DETERGENT

(75) Inventors: Tetsuo Imai, Tokuyama (JP); Satoshi Mochizuki, Tokuyama (JP)

(73) Assignee: Tokuyama Corporation, Yamaguchi (JP)

( * ) Notice: Subject to any disclaimer, the term of this patent is extended or adjusted under 35 U.S.C. 154(b) by 0 days.

(21) Appl. No.: 09/856,623

(22) PCT Filed: Sep. 20, 2000

(86) PCT No.: PCT/JP00/06437

§ 371 (c)(1),
(2), (4) Date: May 24, 2001

(87) PCT Pub. No.: WO01/21750

PCT Pub. Date: Mar. 29, 2001

(30) Foreign Application Priority Data

Sep. 24, 1999 (JP) ..... 11-270499

(51) Int. Cl.[7] ..... C11D 7/32; C11D 7/26; C11D 7/50

(52) U.S. Cl. ..... 510/245; 510/254; 510/264; 510/500; 510/506

(58) Field of Search ..... 510/245, 254, 510/264, 500, 506

(56) References Cited

U.S. PATENT DOCUMENTS 5,064,557 A * 11/1991 Fusiak ..... 252/162
5,597,678 A * 1/1997 Honda et al. ..... 430/331
5,610,132 A 3/1997 Momoda et al. ..... 510/306
5,759,973 A * 6/1998 Honda et al. ..... 510/176
5,792,274 A * 8/1998 Tanabe et al. ..... 134/1.3
5,798,323 A * 8/1998 Honda et al. ..... 510/176
5,905,063 A * 5/1999 Tanabe et al. ..... 510/176
5,968,848 A * 10/1999 Tanabe et al. ..... 438/745
6,103,680 A * 8/2000 Honda et al. ..... 510/178
6,261,745 B1 * 7/2001 Tanabe et al. ..... 430/331
6,268,323 B1 * 7/2001 Honda et al. ..... 510/176

FOREIGN PATENT DOCUMENTS

| | | |
|---|---|---|
| JP | A457963 | 2/1992 |
| JP | A762396 | 3/1995 |
| JP | 83592 | 1/1996 |

* cited by examiner

*Primary Examiner*—Gregory Delcotto
(74) *Attorney, Agent, or Firm*—Birch, Stewart, Kolasch & Birch, LLP

(57) ABSTRACT

To provide a detergent which does not comprise a halogen-based solvent having high cleaning capabilities. The detergent of the present invention comprises (A) a glycol ether having low compatibility with water, preferably propylene glycol alkyl ether having a solubility in water at 60° C. of 50 vol % or less, (B) an imidazolidinone compound represented by the following formula (I):

(I)

wherein $R^1$ and $R^2$ are each independently a methyl group or ethyl group, and (C) water, and forms a homogeneous phase.

3 Claims, 2 Drawing Sheets

DETERGENT

This application is the national phase under 35 U.S.C. § 371 of PCT International Application No. PCT/JP00/06437 which has an International filing date of Sep. 20, 2000, which designated the United States of American and was published in Japanese.

BACKGROUND OF THE INVENTION

1. Field of the Invention

The present invention relates to a detergent for removing fat and oil adhered to a metal part or the like, a stain such as a flux or a fingerprint or the like adhered to an electronic part or the like.

2. Prior Art

Freon-based solvents and halogen-based solvents have been used for the degreasing and cleaning of an object to be cleaned such as a metal part, electronic part or semiconductor part because they are incombustible and secure from ignition and have excellent detergency. However, for the fear of such problems as the destruction of global environment and influence upon the human body, switchover to aqueous detergents which comprise a surfactant and an alkali as essential ingredients, hydrocarbon-based detergents, alcohol-based detergents and quasi-aqueous detergents containing a third petroleum hydrocarbon dispersed in water using a surfactant is now under way.

However, a cleaning method using an aqueous detergent involves such problems as high foamability, insufficient cleaning capabilities, the disposal of a large amount of waste water and the corrosion of an object to be cleaned. Hydrocarbon-based detergents and alcohol-based detergents are both combustible and have low flash points, thereby involving the risk of ignition. Quasi-aqueous detergents have such defects that they become flammable upon phase separation and nonuniform in cleaning properties and a large amount of waste water must be disposed of.

To cope with these problems, JP-A8-3592 (the term "JP-A" as used herein means an "unexamined published Japanese patent application") proposes a detergent which comprises propylene glycol alkyl ether having high compatibility with water, propylene glycol alkyl ether having low compatibility with water and water as essential ingredients. Since this detergent can be made nonflammable by selecting an appropriate amount of water and the glycol ether component having low compatibility with water has high degreasing properties, it has high cleaning capabilities and is very useful when the above components form a homogeneous phase. However, this detergent has still room to be improved in a sense that the composition area where the above components form a homogeneous phase is very narrow. Particularly, when a large amount of the glycol ether having low compatibility with water is contained, the nonflammable area is limited to a very small area and it is difficult to produce a detergent having high cleaning capabilities and high safety.

SUMMARY OF THE INVENTION

The inventors of the present invention have conducted intensive studies to solve the above problems and have found that a specific imidazolidinone compound greatly improves the solubility in water of a polar organic solvent having low compatibility with water and also the degreasing capabilities of a detergent. The present invention has been accomplished based on this finding.

It is therefore an object of the present invention to provide a novel detergent having excellent detergent action and novel composition.

Other objects and advantages of the present invention will become apparent from the following description. According to the present invention, the above objects and advantages of the present invention are attained by a detergent comprising:

(A) a polar organic solvent having low solubility in water;

(B) an imidazolidinone compound represented by the following formula (I):

(I)

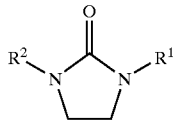

wherein $R^1$ and $R^2$ are each independently a methyl group or ethyl group; and (C) water, and forming a homogeneous phase.

THE PREFERRED EMBODIMENT OF THE INVENTION

Figure 1:
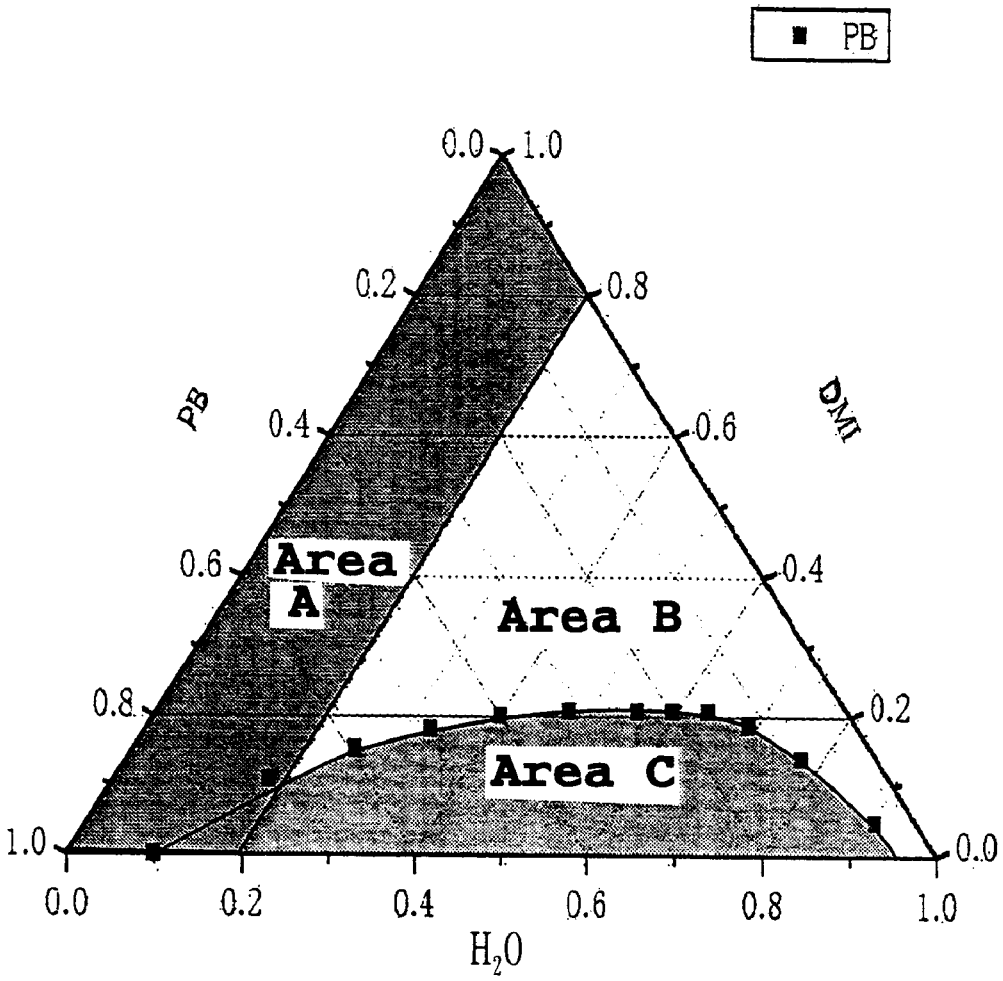
FIG. 1 is a phase diagram of propylene glycol monobutyl ether/1,3-dimethyl-2-imidazolidinone/water at 60° C.

The above component (A) in the present invention is a polar organic solvent having low compatibility with water. The expression "low compatibility with water" means that only a small amount of the component dissolves in water, the solubility in water at 60° C., that is, the proportion of a portion soluble in water is preferably 50 vol % or less, more preferably 30 vol % or less. The expression "polar organic solvent" means an organic solvent having a relative dielectric constant of preferably 8 or more, more preferably 10 or more.

In the present invention, the component (A) has function of giving degreasing capabilities to a detergent. That is, since the polar organic solvent has high solubility in oil and high surface activity, it directly dissolves oil adhered to the surface of an object to be cleaned and easily removes it. When this organic solvent having low compatibility with water is not used, the obtained detergent has insufficient compatibility with oil and cannot obtain sufficient cleaning capabilities. Since an aprotic solvent such as normal paraffin has extremely low compatibility with water even when it is an organic solvent having low compatibility with water, the obtained detergent has poor homogeneity disadvantageously.

Known organic solvents having the above properties may be used as the component (A) without restriction but glycol ether compounds, pyrrolidone compounds and imidazolidinone compounds are preferred and glycol ether compounds are particularly preferred because they exhibit excellent cleaning capabilities.

Glycol ether compounds which may be used as the component (A) include ethylene glycol compounds and propylene glycol compounds. Out of these, propylene glycol alkyl ethers are preferred. Particularly preferred are propylene glycol alkyl ethers represented by the following formula (II):

(II)

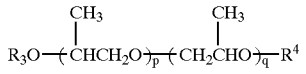

wherein $R^3$ and $R^4$ are each independently a hydrogen atom or alkyl group having 1 to 4 carbon atoms, and p and q are each independently a number of 0 to 3, with the proviso that p+q=1 to 3, $R^3$ and $R^4$ cannot be a hydrogen atom at the same time, when one of $R^3$ and $R^4$ is a hydrogen atom, the other is an alkyl group having 3 or more carbon atoms, and when $R^3$ and $R^4$ are both a methyl group or ethyl group, p+q=2 to 3.

The alkyl group having 1 to 4 carbon atoms represented by $R^3$ and $R^4$may be linear or branched. Examples of the alkyl group include methyl, ethyl, propyl, isopropyl, butyl, isobutyl, sec-butyl and tert-butyl.

The above propylene glycol alkyl ethers include, for example, propylene glycol monopropyl ether, propylene glycol monobutyl ether, dipropylene glycol monobutyl ether, dipropylene glycol monopropyl ether, tripropylene glycol monobutyl ether, dipropylene glycol dimethyl ether, tripropylene glycol dimethyl ether, dipropylene glycol diethyl ether, dipropylene glycol dibutyl ether, propylene glycol monoisopropyl ether and tripropylene glycol tert-butyl ether. Out of these, propylene glycol monobutyl ether and dipropylene glycol monopropyl ether are particularly preferred.

Pyrrolidone compounds represented by the following formula (III) are preferred as the component (A):

(III)

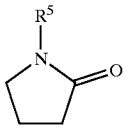

wherein $R^5$ is an alkyl group having 7 to 10 carbon atoms.

The alkyl group having 7 to 10 carbon atoms represented by $R^5$ may be linear or branched, as exemplified by heptyl, octyl, nonyl, decyl and 3-ethylhexyl.

The above pyrrolidone compounds include, for example, N-heptylpyrrolidone, N-octylpyrrolidone, N-(3-ethylhexyl) pyrrolidone and N-decylpyrrolidone. Out of these, N-octylpyrrolidone is particularly preferred.

Imidazolidinone compounds represented by the following formula (IV) are preferred as the component (A):

(IV)

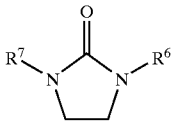

wherein $R^6$ and $R^7$ are each independently an alkyl group having 3 to 5 carbon atoms.

The alkyl group having 3 to 5 carbon atoms represented by $R^6$ and $R^7$ may be linear or branched, as exemplified by propyl, isopropyl, butyl, isobutyl, sec-butyl, tert-butyl and pentyl.

The above imidazolidinone compounds include, for example, 1,3-dipropyl-2-imidazolidinone, 1,3-diisopropyl-2-imidazolidinone, 1-propyl-3-butyl-2-imidazolidinone, 1,3-dibutyl-2-imidazolidinone and 1,3-dipentyl-2-imidazolidinone. Out of these, 1,3-dipropyl-2-imidazolidinone and 1,3-diisopropyl-2-imidazolidinone are particularly preferred.

In the present invention, the above polar organic solvents having low compatibility with water may be used alone or in combination of two or more.

In the present invention, a propylene glycol alkyl ether represented by the above formula (II) is the most preferably used as the polar organic solvent having low compatibility with water from the viewpoints of excellent cleaning properties, easy acquisition and price.

In the present invention, the component (B) is an imidazolidinone compound represented by the following formula (I):

(I)

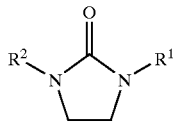

wherein $R^1$ and $R^2$ are each independently a methyl group or ethyl group.

This component has the function of greatly improving compatibility between the above component (A) and water. Also as this component itself has a degreasing function, it can improve the degreasing capabilities of the detergent.

Examples of the imidazolidinone compound include 1,3-dimethyl-2-imidazolidinone and 1,3-diethyl-2-imidazolidinone. Out of these, 1,3-dimethyl-2-imidazolidinone is particularly preferred. These imidazolidinone compounds may be used alone or in combination of two or more.

In the present invention, water as the component (C) has the function of reducing the flammability of the components (A) and (B), thereby eliminating the need for an explosion prevention apparatus, whereby a detergent which is advantageous in terms of equipment costs and solution handling can be obtained.

When the above components (A), (B) and (C) are mixed together, there are formed an area where the obtained mixture forms a homogeneous phase and an area where the mixture is separated into two phases, according to the ratio of these components. Propylene glycol monobutyl ether (PB) as the component (A), 1,3-dimethylimidazolidinone (DMI) as the component (B) and water as the component (C) are used in Example 1 which will be described later, and a phase diagram of a three-component system measured at 60° C. is shown in FIG. 1. Dipropylene glycol monomethyl ether is used as the component (B) in the above composition in Comparative Example 1 and a phase diagram of a three-component system measured at the same temperature is shown in FIG. 2.

The area C is an area where the three components do not dissolved uniformly and an oil phase and a water phase are formed. In FIG. 1 and FIG. 2, the area A and the area B are an area where the three components dissolve in one another and form a homogeneous phase. Although a detergent having one of the above areas A and B may be used in the present invention, a detergent having the area A has a small water content and flammability. Therefore, a detergent having the area B without flammability is preferably used. The expression "detergent without flammability" means a solution whose flash point cannot be observed by the Cleveland flash point measurement method (JIS K2265).

As described above, the detergent of the present invention is used in a state that the three components (A), (B) and (C) form a homogeneous phase. To obtain high detergency, the higher content of the component (B) is preferred but it must be in such a range that the three components (A), (B) and (C) form a homogeneous phase.

Figure 2:
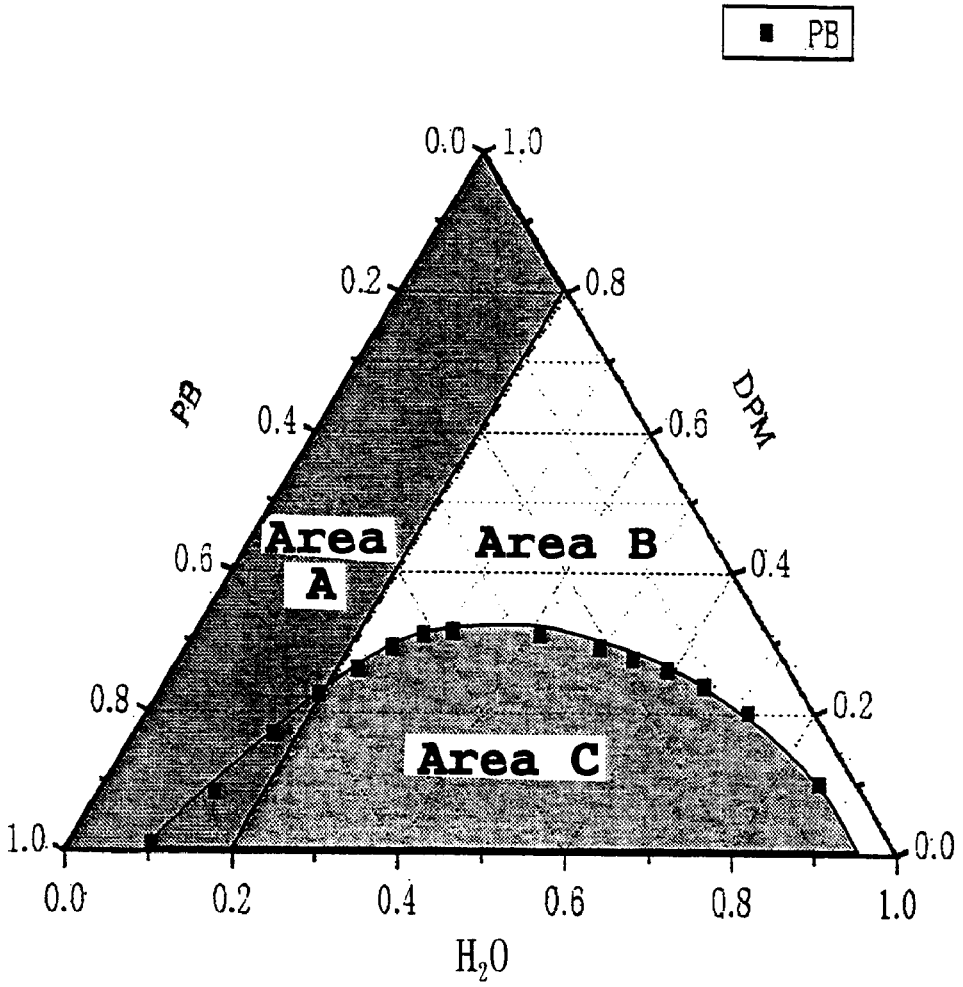
FIG. 2 is a phase diagram of propylene glycol monobutyl ether/dipropylene glycol monomethyl ether/water at 60° C.

As obvious from comparison between FIG. 1 and FIG. 2, when an imidazolidinone compound represented by the following formula (I) is used as the component (B), the area C in FIG. 1 can be made extremely small.

(I)

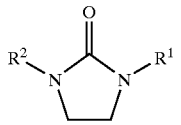

As a result, even when the content of the component (A) is increased, the homogeneity of the solution is maintained and a cleaning solution having greatly improved cleaning capabilities can be obtained.

The ratio of the components cannot be determined simply because water solubility slightly varies according to the type of each component. Generally speaking, the amount of the component (A) is preferably 25 vol % or more based on the total amount of the components (A), (B) and (C). To obtain a detergent having more excellent cleaning capabilities, the amount of the component (A) is more preferably 50 vol % or more, particularly preferably 55 vol % or more. The amount of the component (B) is preferably 5 vol % or more, particularly preferably 10 vol % or more. Further, the amount of the component (C) is preferably 5 vol % or more, particularly preferably 20 vol % or more to make the detergent nonflammable. As for the upper limits of the components (A), (B) and (C), the upper limit of the component (A) is 90 vol %, preferably 70 vol %, the upper limit of the component (B) is preferably 70 vol %, more preferably 25 vol %, and the upper limit of the component (C) is preferably 70 vol %, more preferably 30 vol %.

Any known cleaning method using the detergent of the present invention may be used without restriction. For example, a method in which an object to be cleaned having fat and oil adhered thereto is immersed in the detergent and a method in which the detergent is showered or sprayed onto the object to be cleaned having fat and oil adhered thereto may be employed. When these methods are used in combination with such means as ultrasonic cleaning, shaking or agitation, cleaning can be carried more effectively.

The cleaning temperature is not particularly limited but preferably 30 to 80° C., more preferably 40 to 70° C. from the viewpoint of balance between temperature dependence of phase separation and cleaning capabilities.

The solubility in the detergent of oil has its limit. Out of oil removed from the object to be cleaned, a portion beyond the solubility separates from the detergent as floating oil or precipitated oil spontaneously. Therefore, oil can be easily separated by treating the detergent after cleaning with an oil-water separater. The recovered detergent is not contaminated by oil and retains high detergency for a long time.

The solubility in the detergent of oil can be easily adjusted by the component (C), namely the content of water. That is, by reducing the content of the component (C), a detergent having high oil solubility and high degreasing capabilities can be obtained and by increasing the content of the component (C), a solution having low oil solubility and high oil-water separation capabilities can be obtained.

In the present invention, it is efficient to clean using a technique for cleaning an object to be cleaned by combining a plurality of cleaning solutions which differ in the content of the component (C), specifically cleaning the object using a cleaning apparatus equipped with a pre-stage tank and a post-stage tank, that is, using a solution having a small content of the component (C) as a cleaning solution in a pre-stage cleaning tank of the apparatus and then cleaning the object using a solution having a large content of the component (C) as a cleaning solution in the post-stage cleaning tank of the apparatus. According to this cleaning system, oil is easily removed from the object with higher cleaning efficiency and easily eliminated from the system advantageously.

All the components of the detergent of the present invention are organic solvents and water and there is no residue after evaporation. Therefore, even when the detergent is adhered to the object and dried, a salt is not deposited unlike an aqueous detergent and does not exert a bad influence upon the object.

The detergent of the present invention has a wide composition area where the components (A), (B) and (C) form a homogeneous phase, particularly a wide composition area where the component (A) having excellent degreasing capabilities, namely the polar organic solvent having low compatibility with water is contained in a large amount. Therefore, a detergent containing a large amount of the component (A) and having excellent cleaning capabilities is easily produced and a nonflammable detergent is advantageously produced.

Since the component (B), namely the imidazolidinone compound represented by the above formula (I) itself also improves degreasing properties, the effect of improving cleaning capabilities is exhibited in an entire composition area where a homogeneous phase is formed.

EXAMPLES

The following examples are provided for the purpose of further illustrating the present invention but are in no way to be taken as limiting.

The organic solvents used in the examples and comparative examples are as follows.

Component (A)

PB: propylene glycol monobutyl ether (solubility in water at 60° C.: 6 vol %)

DPP: dipropylene glycol monopropyl ether (solubility in water at 60° C.: 10 vol %)

DPDE: dipropylene glycol diethyl ether (solubility in water at 60° C.: 5 vol %)

DPI: 1,3-dipropyl-2-imidazolidinone (solubility in water at 60° C.: 12 vol %)

NOP: N-octylpyrrolidone (solubility in water at 60° C.: 13 vol %) component B

DMI: 1,3-dimethyl-2-imidazolidinone (compatible with water at 60° C. in any ratio)

DEI: 1-ethyl-3-methyl-2-imidazolidinone (compatible with water at 60° C. in any ratio) others DPM: dipropylene glycol monomethyl ether (compatible with water at 60° C. in any ratio)

DPG: dipropylene glycol (compatible with water at 60° C. in any ratio)

Example 1 and Comparative Example 1

A phase diagram of a three-component system when propylene glycol monobutyl ether as the component (A), 1,3-dimethyl-2-imidazolidinone as the component (B) and water as the component (C) were mixed together at 60° C. was measured. The results are shown in FIG. 1.

For comparison, a phase diagram of a three-component system in which the component (B) was substituted by dipropylene glycol monomethyl ether at the same temperature was measured. The results are shown in FIG. 2.

Examples 2 to 16 and Comparative Examples 2 to 10

A detergent 1L having a homogeneous phase shown in Table 1 was used to clean a test piece having about 50 mg of commercial machine oil adhered on an aluminum plate measuring 50×80×1 mm. Cleaning was carried out by immersing the test piece in the detergent shown in Table 1 at 60° C. for 30 seconds. After cleaning, the test piece was pulled up and rinsed in 20° C. running water for 1 minute and dried at 80° C. for 20 minutes to evaluate the oil removal rate by the gravimetric method. The results are shown in Table 1.

As Comparative Examples, solutions shown in Table 1 were prepared and the same test as in Examples was made on these solutions. Some solutions were separated into two phases when they were heated at 60° C. so they could not be used as a homogeneous detergent. The results are shown in Table 1.

TABLE 1

| | detergent | volumetric ratio (vol %) | flammability | oil removal rate (%) |
|---|---|---|---|---|
| Ex. 2 | PB/DMI/water | 50/20/30 | nonflammable | 92 |
| Ex. 3 | PB/DMI/water | 61/14/25 | nonflammable | 95 |
| Ex. 4 | PB/DMI/water | 75/10/15 | flammable | 99 |
| Ex. 5 | PB/DMI/water | 35/44/21 | nonflammable | 85 |
| Ex. 6 | PB/DMI/water | 35/35/30 | nonflammable | 83 |
| Ex. 7 | PB/DMI/water | 35/10/55 | nonflammable | 80 |
| Ex. 8 | DPP/DMI/water | 50/20/30 | nonflammable | 92 |
| Ex. 9 | DPP/DMI/water | 65/10/25 | nonflammable | 97 |
| Ex. 10 | DPP/DMI/water | 65/25/10 | flammable | 98 |
| Ex. 11 | DPI/DMI/water | 60/19/21 | nonflammable | 96 |
| Ex. 12 | DPI/DMI/water | 70/20/10 | flammable | 99 |
| Ex. 13 | DPDE/DMI/water | 60/19/21 | nonflammable | 98 |
| Ex. 14 | NOP/DMI/water | 60/19/21 | nonflammable | 99 |
| Ex. 15 | PB/DEI/water | 50/20/30 | nonflammable | 97 |
| Ex. 16 | DPI/DEI/water | 50/20/30 | nonflammable | 96 |
| C. Ex. 2 | PB/DPM/water | 35/35/30 | nonflammable | 65 |
| C. Ex. 3 | DPP/DPM/water | 50/20/30 | — | — |
| C. Ex. 4 | DPP/DPM/water | 65/10/25 | — | — |
| C. Ex. 5 | DPP/DPM/water | 65/25/10 | flammable | 90 |
| C. Ex. 6 | DPI/DPM/water | 60/19/21 | — | — |
| C. Ex. 7 | DPI/DPM/water | 70/20/10 | flammable | 91 |
| C. Ex. 8 | NOP/DPM/water | 60/19/21 | — | — |
| C. Ex. 9 | NOP/DPG/water | 60/19/21 | — | — |
| C. Ex. 10 | DPM/water | 70/30 | nonflammable | 41 |

*A phase separation phenomenon occurred in Comparative Examples 3, 4, 6, 8 and 9 at 60° C.

What is claimed is:

1. A detergent which comprises:

(A) 50 vol % or more of a polar organic solvent having low compatibility with water;

wherein the polar organic solvent having low compatibility with water is at least one compound selected from the group consisting of a propylene glycol alkyl ether compound represented by the following formula II:

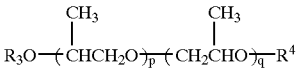

(II)

wherein $R^3$ and $R^4$ are each independently a hydrogen atom or alkyl group having 1 to 4 carbon atoms, and p and q are each independently a number from 0 to 3, with the proviso that p+q=1 to 3, $R^3$ and $R^4$ cannot be a hydrogen atom at the same time, when one of $R^3$ and $R^4$ is a hydrogen atom, the other is an alkyl group having 3 or more carbon atoms, and when $R^3$ and $R^4$ are both a methyl group or ethyl group, p+q=2 to 3, (B) 10 vol % or more of an imidazolidinone compound represented by the following formula (I):

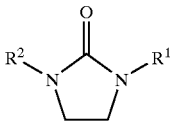

(I)

wherein $R^1$ and $R^2$ are each independently a methyl group or ethyl group; and (C) 21 vol % or more of water the above vol % being based on the total volume of the polar organic solvent, the imidazolidinone and the water, and which forms a homogeneous phase and is used at a temperature of 40° C. to 70° C.

2. The detergent of claim 1, wherein the polar organic solvent having low compatibility with water (A) has a solubility in water at 60° C. of 50 vol % or less.

3. The detergent of claim 1 for degreasing a metal part, electronic part or semiconductor part.

* * * * *